US005695558A

United States Patent [19]

Eastwood

[11] Patent Number: 5,695,558

[45] Date of Patent: Dec. 9, 1997

[54] VESSEL REPAIR

[75] Inventor: Owen Eastwood, Rotherham, England

[73] Assignee: Monocon International Refractories Limited, Doncaster, United Kingdom

[21] Appl. No.: 553,246

[22] PCT Filed: May 20, 1994

[86] PCT No.: PCT/GB94/01113

§ 371 Date: Nov. 14, 1995

§ 102(e) Date: Nov. 14, 1995

[87] PCT Pub. No.: WO94/29658

PCT Pub. Date: Dec. 22, 1994

[30] Foreign Application Priority Data

Jun. 5, 1993 [GB] United Kingdom ..... 9311686

[51] Int. Cl.[6] ..... F27D 1/36

[52] U.S. Cl. ..... 118/308; 118/323; 118/306; 118/669; 118/681; 29/402.18; 266/231

[58] Field of Search ..... 118/308, 323, 118/318, 305, 306, 669, 681; 29/402.18; 239/222; 266/231; 264/30

[56] References Cited

FOREIGN PATENT DOCUMENTS 3639083 8/1987 Germany .

*Primary Examiner*—Donald E. Czaja
*Assistant Examiner*—Calvin Padgett
*Attorney, Agent, or Firm*—Trexler, Bushnell, Giangiorgi & Blackstone, Ltd.

[57] ABSTRACT

The invention relates to the repair of vessels, particularly refractory-lined vessels such as are used in steelmaking. Frequently there is wear on the lining of such vessels sufficient to prevent the use of the vessel without repair but insufficient to justify the costs of completely re-lining the vessel. The object of the present invention is to provide relatively simple and efficient repair apparatus (1) for applying particulate refractory material to a vessel (2) wall where required, which objective is met by apparatus to enable the repair of the refractory lining comprising a rotatable member (4), rotatably mounted substantially at the end of a carrier (3) adapted to locate the rotatable member (4) at a required position in the vessel, a drive structure (6) for the rotatable member, structure associated with the carrier to direct and deposit a particulate refractory material onto the rotatable member (4), said carrier and/or said structure associated with said carrier being circumferentially adjustable to deposit the particulate material at a predetermined position on the rotatable member and whereby to achieve a required direction of discharge of material ejected form the rotatable member.

12 Claims, 3 Drawing Sheets

FIG. 2 SECTION II-II

VESSEL REPAIR

This invention relates to the repair of vessels, and particularly refractory-lined vessels.

With refractory-lined vessels such as are used in steelmaking, such as for example, furnaces, ladles, tundishes, and the like, it is inevitable that there is wear of the refractory lining. Frequently, the wear on the lining is insufficient to justify the costs of complete relining of the vessel, but is greater than is permitted to allow the vessel to be re-used without repair.

With such as, for example, an electric arc furnace, there are known locations on the lining where greatest wear takes place, on the wall of the lining in closest proximity to each of the three electrodes ordinarily employed, and circumferentially of the lining at the slag line. Similar considerations can apply to other vessels, such as basic oxygen furnaces where there are two principal points of wear of its lining at diametrically opposite locations on the line of the axis through the trunnions.

Conventionally, localised repair is effected by so-called gunning techniques, where a slurry of a required refractory material is directed at the wall through a nozzle at the end of a supply hose. In some circumstances the nozzle is hand-held requiring the operative to position himself above the furnace with its roof removed, both hazardous and inefficient because of inconvenient positioning of an operative relative to the required area where repair is required. In other circumstances a nozzle is provided on a carrier to locate the nozzle within the furnace, with a means to enable the nozzle to be driven arcuately. Whilst avoiding operator difficulties effective equipment is expensive, and relatively inefficient, with noticeable constraints on the volume/weight of refractory material that can be dispensed in unit time.

There are other known forms of equipment involving a spinning disc below a dispensing hopper, to be lowered into the furnace, with a series of movable gates associated with the spinning disc attempting to control the direction in which material deposited on the disc will be discharged against the furnace wall. Given the nature of refractory repair material, equipment of this nature is prone to becoming blocked, with jamming of the gates open or closed, and with the frequent need for it to be stripped and cleaned. It is also the case that the gates cannot be a sliding sealing fit on the rotating member, allowing refractory material to pass below a closed gate and simply fall to the floor, a wasteful loss of refractory material. In addition, the placement of a hopper and its associated rotatable disc within a vessel must be by an overhead crane. Overhead cranes in steelmaking plants are in constant use, and there is a considerable inconvenience in having the overhead crane out of commission whilst it is holding the hopper in the vessel for the time required for repair of the lining to be completed.

With vessels such as, for example, steelmaking furnaces, it is traditionally so that a bank of loose course granular refractory material is deposited as a bank at the junction of the furnace side walls and furnace floor to provide a smooth transition from the furnace wall to the furnace floor. During steelmaking there is inevitable erosion of the bank, frequently requiring its repair or renewal before the furnace can be re-used. Accurate deposit of fresh granular material to a bank at its points of required repair has similar and comparable difficulties with those mentioned above in connection with lining repair.

The object of the present invention is to provide for the repair of refractory lined vessels free from those disadvantages mentioned above.

According to the present invention, means to enable the repair of a refractory lining of a metallurgical vessel comprises a rotatable member, rotatably mounted at or towards the end of a carrier means adapted to locate the rotatable member at a required position in the vessel, a drive means for the rotatable member, means operable to activate the carrier to direct and deposit a particulate refractory material on to the rotatable member said carrier and/or said means associated with said carrier being circumferentially adjustable to deposit the particulate material at a predetermined position on the rotatable member and whereby to achieve a required direction of throw of material ejected from the rotatable member. Preferably, the rotatable member is provided with vanes or blades.

It has been found that particulate refractory material, in wet or dry condition, deposited on to a rotatable member, is thrown from the member in fixed angular relationship to the point of deposit of the material on to the member. Thus, by arranging for circumferential adjustability of a carrier for a rotating member, and/or a means associated with the carrier to deposit material onto the member, material can be caused to be thrown from the member in any required direction. In addition to the material being thrown from the rotating member in a required direction, it is equally the case that the material is thrown with an angular spread both transversely and vertically. Consequently, a fan-like linear distribution of particulate material is immediately formed at the required position on the wall of the vessel at its required position, the length of the applied material being more than adequate to extend across the worn area at that point on the vessel wall.

With such vessels as electric arc furnaces, the wear that occurs on the wall behind an electrode is deeper immediately behind the electrode and becomes shallower in both directions in the transverse direction. Of notable importance with the invention is that the manner by which material is thrown from the rotatable member is such as to create a fan-like linear distribution of particulate material that is thinner at the transverse peripheries and thicker at the centre of the fan-like linear distribution of particulate material. When applied to the wear behind an electrode, the result is the restructuring of the wall at that point with a substantially planar surface.

It is preferred that the particulate material is deposited on the rotatable member at between 80° and 120° from the approximate centre plane of the fan-like linear distribution of particulate material in the direction opposite to that of rotation of the rotatable member. Further preferably, particulate material is deposited at 100° from the approximate centre plane of the fan-like linear distribution of particulate material.

The rotatable member may be a disc, a barrel, or a drum.

Thus with the rotatable member set at a position commensurate with one extremity of a worn area on a vessel wall, rotation of the rotatable member and the deposit of particulate material on to it causes the creation of a repair patch by the fan-like linear distribution of particulate material at that point. With then the rotatable member gradually moved over the worn area the position of the patch being formed on the wall is moved, and the whole of the worn area can be repaired with considerable ease and efficiency. Another, and most important advantage, is that repair when effected in this manner and by the invention, has the beneficial effect of the substantial, if not total, elimination of any problem caused by the rebounding of particulate material from the vessel wall, and the prevention of rebound has the important advantage of avoiding loose particulate material gathering on the vessel floor.

The carrier for the rotatable member may be a relatively simple robotic arm able to be brought within the vessel, and adjustable as to its position to locate a rotatable member mounted on the end of the robotic arm at a required start point within the vessel. The means associated with the carrier may be a relatively simple feed pipe to transport refractory material to the rotatable member. Circumferential adjustability can be provided for by having the e.g. feed pipe, secured to the e.g. robotic arm, and the robotic arm rotatable about its own axis. Equally, circumferential adjustability can be achieved by mounting the e.g. feed pipe, on the e.g. robotic arm, such that at least the outlet from the feed pipe can be rotated around the arm.

The carrier, e.g. robotic arm, may be provided with mounting means for direct attachment to the outer wall of the vessel, with an appropriate drive means to enable the robotic arm to be brought from an inoperative position outside the vessel to an operative position within the vessel. Preferably, however, mounting means for the carrier is a superstructure positioned adjacent the vessel wall. Equally, the carrier, e.g. robotic arm, could be mounted on a tractor means to enable the carrier, e.g. robotic arm, to be brought to the side of a vessel as and when required, and the carrier e.g. robotic arm, positioned within it.

Following the emptying of a vessel, visual inspection can readily determine if and where repair of its wall lining is required, and if an arc furnace, if and where there has been damage/erosion of the bank that requires repair. The carrier can then be brought within the vessel under the control of an operative, set as to its position, and either the carrier rotated, or the means associated with the carrier rotated to position the deposit point of material to the rotatable member such that material with entrained water will be thrown from the rotatable member at the vessel wall, or dry material at the bank, precisely where repair is to be effected. To assist in the accurate deposit of dry material thrown from the rotatable member at a bank, a deflector means can be provided to impose a downward direction to the material as it is thrown in the required radial direction.

A further advantageous feature of the invention, in addition to providing directional control over material ejected from the rotatable member, is that all-round, or circumferential, application of material can be achieved, either by continuously rotating the carrier about its own axis, or continuously rotating at least the feed pipe outlet about the carrier whilst material is being deposited on the rotatable member.

The invention lends itself admirably to the particular circumstances that apply to electric arc furnaces. Ordinarily, such furnaces have three electrodes, and it is well-known in the art that such furnaces have known principal wear points, such as on the wall behind each of the electrodes and circumferentially at the slag line. Thus, equipment in accordance with the invention may be provided with a control means such that on first introduction of the carrier/robotic arm into the furnace, the arm, or the feed pipe outlet for refractory material, is set at a position where material will be thrown from the rotatable member towards one worn point on the lining, with the arm or the supply hose outlet indexable to bring it to a predetermined second, and subsequently to a predetermined third, position, and whereby the repair of the three known wear points can be effected in an automatic, or semi-automatic, manner. Following the repair of such wear points on the wall, the arm can be adjusted to put the rotatable member on the slag line, and the arm or the supply hose outlet continuously rotated to effect circumferential application of material to repair the wear at the slag line.

Similar considerations apply to basic oxygen furnaces, where, if on a visual inspection it is confirmed that unacceptable wear has taken place at diametrically opposite points on the wall lining or other wear areas, such as the charge pad and nose cone, the control means can be set such that the equipment is brought to a condition where material is thrown at one worn point, and the carrier or the supply hose outlet indexed to cause material to be thrown at the second worn point on the lining.

With other vessels, such as, for example, ladles and tundishes, there is a more general wear of the linings. Here the control equipment can be employed to provide a continuous adjustment of the position of the rotatable member, in conjunction with a rotation of the carrier or the supply hose outlet, to achieve the automatic provision of a coating of refractory material over the full circumference of the lining and over any required distance.

The invention will now be described, in greater detail, by way of example only, with reference to the accompanying drawings, in which.

Figure 1:
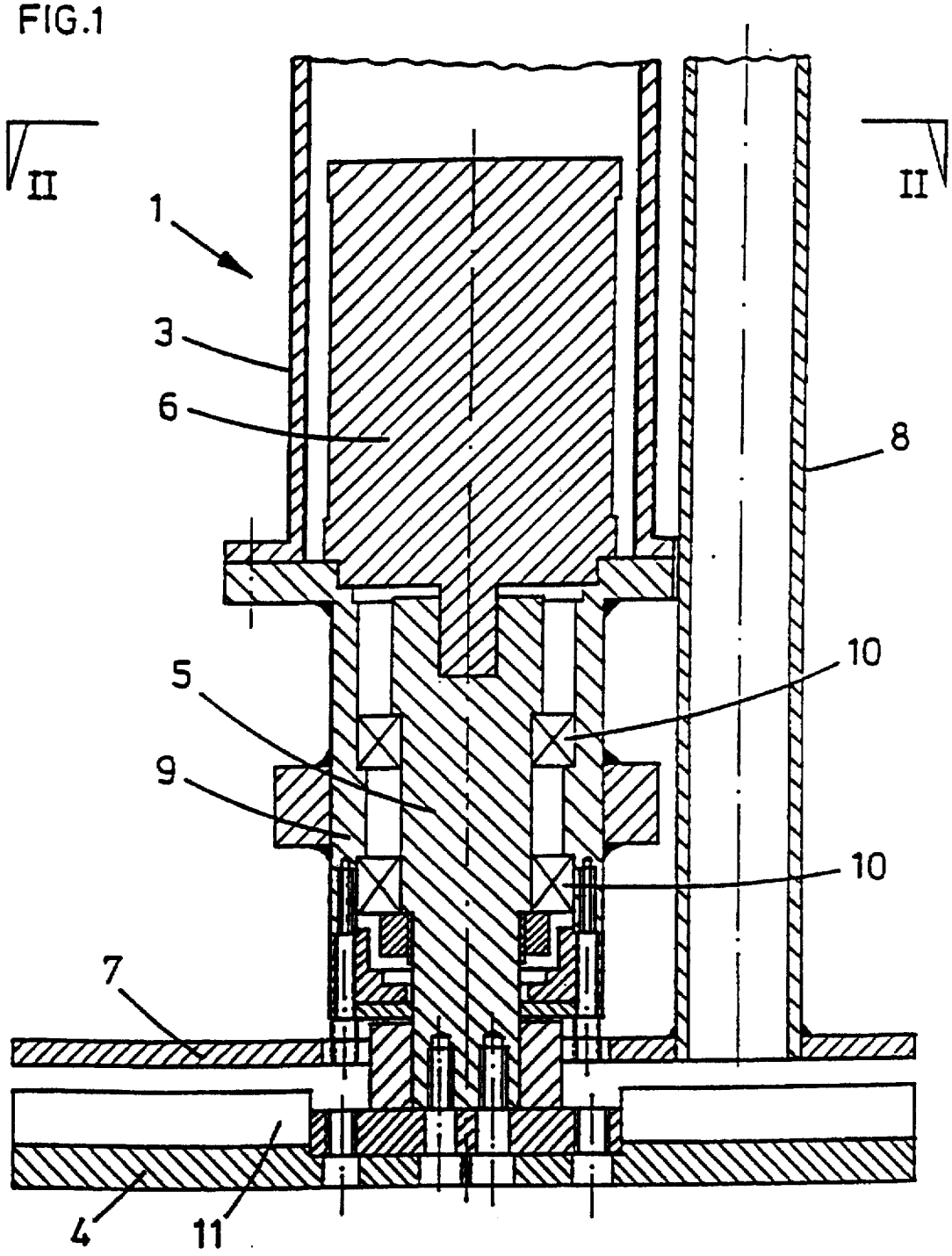
FIG. 1 is a sectional side elevation through the lower end of a carrier means, associated rotatable member and material deposit means.
Figure 2:
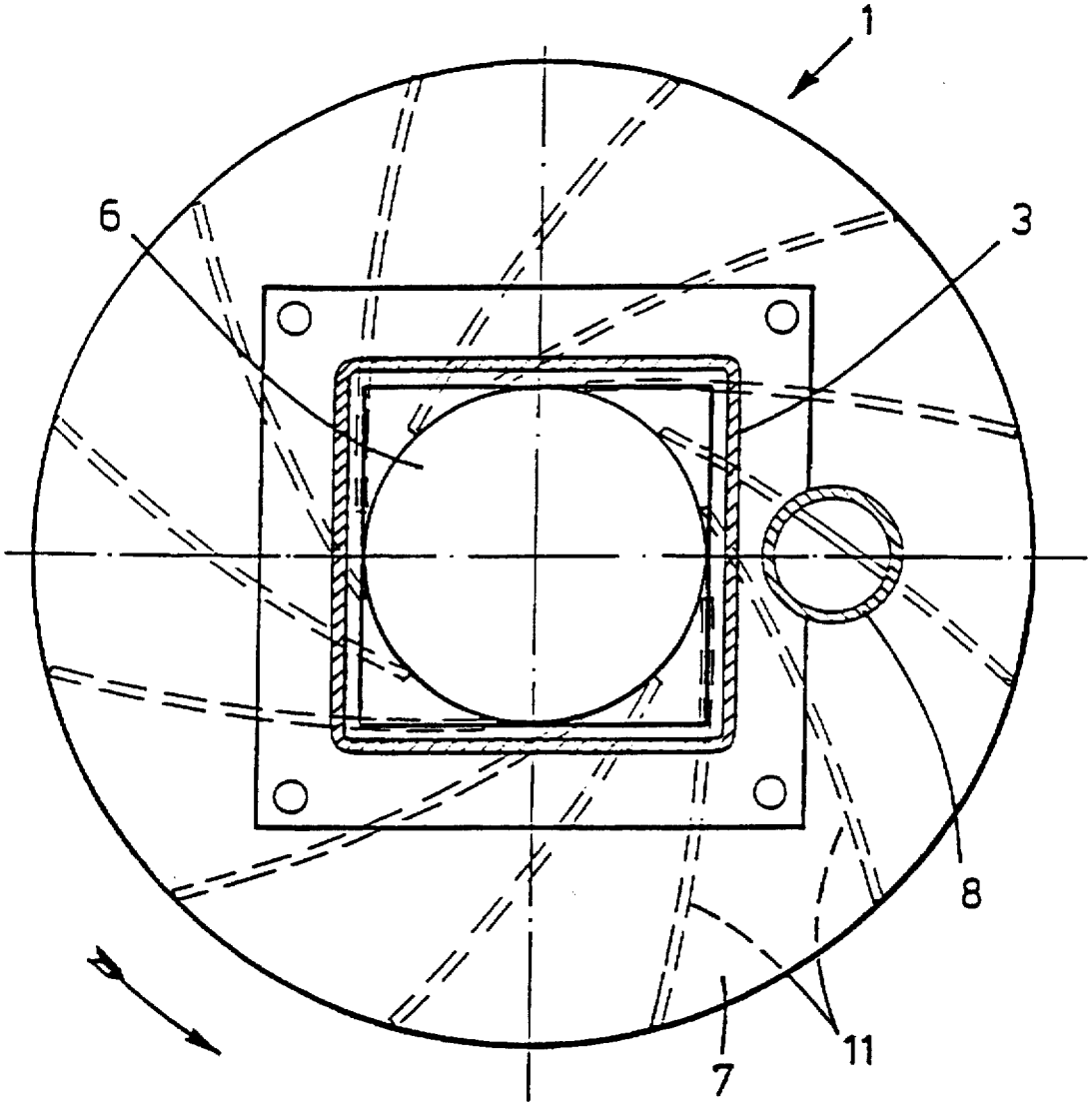
FIG. 2 is a section on the line II—II of FIG. 1.

In the drawings, a means 1 to enable the repair of a refractory lining of a metallurgical vessel 2 is formed by a carrier means 3 in the form of a mast that may be part of a robotic arm that can be positioned within the metallurgical vessel as and when required. At the end of the carrier means 3 a rotatable member in the form of a spinner disc 4 is provided having a drive shaft 5 extending to a hydraulic motor 6 located within the adjacent end of the carrier means 3. In fixed spaced relationship to the spinner disc 4 is a location plate 7 for a material feed pipe 8 extending along the length of the carrier means 3. The location plate 7 is secured to a housing 9 itself attached to the end of the carrier means, the housing 9 serving as a bearing housing for taper roll bearings 10 for the drive shaft 5.

In one form of construction, the material feed pipe 8 is directly attached to the carrier means 3, and the carrier means 3 together with the feed pipe 8 being mounted for rotation about the longitudinal axis of the carrier means, to adjust the position of the feed pipe 8 about the longitudinal axis of the carrier means 3 and hence the axis of rotation of the spinner disc 4. In an alternate form of construction, the material feed pipe 8 and the location plate 7 can be rotated about the carrier means 3, to achieve the same result, the positioning of the feed pipe about the longitudinal axis of the carrier means and hence the axis of rotation of the spinner disc.

As is shown, it is highly desirable that the spinner disc is provided with vanes 11 generally radially disposed and of shallow, convex shape in the direction of rotation of the spinner disc.

Figure 3:
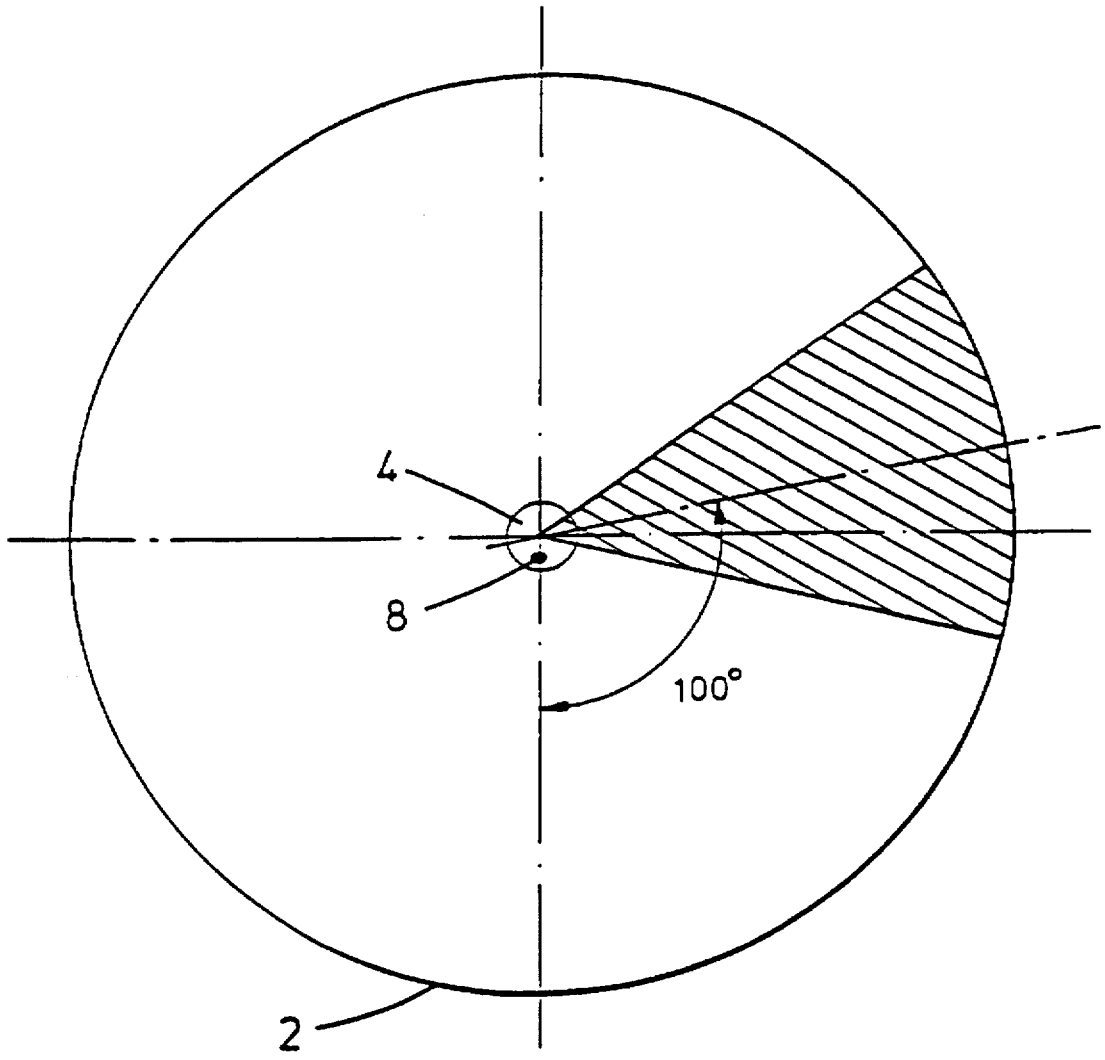
FIG. 3 is a schematic representation illustrating the manner by which material is thrown from the rotatable member.

The invention is based on the surprising realisation that with, such as, a spinner disc rotating, particulate refractory material, in wet or dry condition, can be applied against it at a predetermined point, and which will be ejected from the spinner disc as a fan-like linear distribution, as is illustrated schematically in FIG. 3, with a substantially guaranteed mean angular relationship of approximately 100° between the point of deposit and the direction of throw of the material, and which renders totally superfluous the need for any containing walls or movable gates surrounding the spinner disc, with the total avoidance of any risk of the clogging of particulate refractory material and consequential need for the provision of a drive motor of higher power than is required to rotate the spinner disc because of the absence of any frictional forces that need to be overcome.

The invention lends itself ideally to both manual and automatic control. Thus, a furnace or other metallurgical vessel can be visually inspected by an operative to determine the position of any worn areas on the lining of the vessel, and following which the carrier means 3 can be brought within the furnace to position the spinner disc 4 at one edge of a worn area and to position the feed pipe 8 in relation to the spinner disc 4 such that material urged into contact with the spinner disc will be ejected from the spinner disc in the required direction to apply the fan-like linear distribution of particulate refractory material to the worn area, and the carrier means 3, along with the spinner disc 4, adjusted in position to cause the fan-like linear distribution to progress along the worn area. Thus, once one worn area has been attended to, the operative can bring the carrier means 3 and hence the spinner disc 4 to a required different position with appropriate adjustment of the position of the feed pipe 8 to enable the fan-like linear distribution of particulate material to be applied against a second or subsequent worn area.

With certain metallurgical vessels, such as, for example, electric arc furnaces, it is well-known that there will be principal wear points on the vessel lining such as, for example, behind each of the electrodes and circumferentially at the slag line, and in such as, basic oxygen furnaces, at diametrically opposite points on the wall lining and at, such as, the charge pad and nose cone. Thus, microprocessor control means may be provided and preprogrammed such that with the carrier means 3 brought within a particular furnace to position the spinner disc at a required height, and with the feed pipe adjusted such that particulate material will first be thrown against one worn point, the microprocessor control can readily cause the movement of the carrier and hence the spinner disc to cause the application of particulate refractory material over the area of the first worn point, following which the microprocessor can bring the carrier and re-position the feed pipe 8 to enable the particulate refractory material to be thrown against a second, or subsequent, worn point around the inner periphery of the vessel lining.

I claim:

1. A means to enable the repair of a refractory lining of a metallurgical vessel comprising a rotatable member, rotatably mounted substantially at the end of a carrier means adapted to locate the rotatable member at a required position in the vessel, a drive means for the rotatable member, a means operable to activate the carrier means to direct and deposit a particulate refractory material onto the rotatable member, said carrier means and/or said activation means with said carrier means being circumferentially adjustable to deposit the particulate material at a predetermined position on the rotatable member and whereby to achieve a required direction of discharge of material ejected from the rotatable member.

2. The repair means of claim 1, wherein the rotatable member is provided with vanes or blades.

3. The repair means of claim 1 or claim 2, wherein the particulate material is deposited on the rotatable member at between 80° and 120° from the mean direction of discharge of the particulate material from the rotatable member.

4. The repair means of claim 3, wherein the particulate material is deposited on the rotatable member at approximately 100° from the mean direction of discharge of the particulate material from the rotatable member.

5. The repair means of claim 1 wherein the feed pipe means is made circumferentially adjustable by securing said feed pipe means to said carrier means, and the carrier means is positioned and arranged rotatable relative to the rotatable means, whereby rotation of the carrier means causes rotation of the feed pipe means.

6. The repair means of claim 1 wherein the feed pipe means is made circumferentially adjustable by securing said feed pipe means directly to said carrier means so that the feed pipe means can be rotated around the carrier means.

7. The repair means of claim 1 wherein the carrier means is a robotic arm able to be brought within the vessel and adjustable to locate the rotatable member mounted at the end of the robotic arm at a required start point within the vessel.

8. The repair means of claim 7, wherein the robotic arm is provided with a mounting means for direct attachment to the outer wall of the vessel with a drive means to enable the robotic arm to be brought from an inoperative position outside the vessel to an operative position within the vessel.

9. The repair means of claim 7, wherein the carrier means is provided with a mounting means that is a support structure positioned adjacent the vessel wall.

10. The repair means of claim 7, wherein the carrier means is mounted on a tractor means to enable the carrier means to be brought to the side of a vessel when required and to position the carrier means within the vessel.

11. The repair means of claim 1 wherein a manual adjustment means are provided for the positioning of the carrier means within a vessel and the positioning of the activation means to deposit a particulate refractory material onto the rotatable member.

12. The repair means of claim 1 wherein an automatic microprocessor means are provided for the positioning of the carrier means within a vessel and the positioning of the activation means to deposit a particulate refractory material onto the rotatable member.

* * * * *